United States Patent [19]

Mrdjenovich

[11] 3,976,476

[45] Aug. 24, 1976

[54] HIGH TEMPERATURE CAST AUSTENITIC EXHAUST VALVE

[76] Inventor: Robert Mrdjenovich, 1800 Monticello Drive, Trenton, Mich. 48183

[22] Filed: Dec. 23, 1974

[21] Appl. No.: 535,925

[52] U.S. Cl. ..... 75/128 A; 75/125; 75/128 C; 75/128 W; 75/128 B

[51] Int. Cl.[2] ..... C22C 38/22; C22C 38/38

[58] Field of Search ..... 75/128 A, 128 B, 128 C, 75/128 W, 125, 126 B, 126 C

[56] References Cited

UNITED STATES PATENTS

| | | | |
|---|---|---|---|
| 2,225,730 | 12/1940 | Armstrong | 75/128 W X |
| 3,152,934 | 10/1964 | Lula et al. | 75/128 W X |
| 3,853,545 | 12/1974 | Kusaka et al. | 75/128 A |
| 3,859,083 | 1/1975 | Kusaka et al. | 75/128 A |

*Primary Examiner*—C. Lovell
*Assistant Examiner*—Arthur J. Steiner

[57] ABSTRACT

A new high temperature as-cast austenitic stainless steel is disclosed which is particularly suited for exhaust valve applications in automotive engines. The austenitic steel has improved creep strength, fatigue resistance, ductility, hardness and tensile strength at a temperature level of at least 1700°F. The new steel has a composition, by weight percentage, within the following limits: carbon 0.35–0.95, manganese 2.5–4.0, chromium 16.0–19.0, nickel 10.0–12.0, molybdenum 7.0–8.0, silicon 2.5 max., copper 1.0 max., cobalt 3.0 max., other elements each no greater than 0.2 max. and all other elements as a total no greater than 3.5 max., the remainder being iron.

8 Claims, No Drawings

HIGH TEMPERATURE CAST AUSTENITIC EXHAUST VALVE

BACKGROUND OF THE INVENTION

The operating temperature for automotive exhaust valves has been dramatically increased and continues to be increased as new engine cycles are altered by the addition of anti-pollution devices. Increased exhaust gas temperatures are beneficial because they promote improved functioning of thermal reactors and permit some additional chemical reaction to take place within the exhaust system independent of either a thermal reactor or catalytic converter. Automotive companies currently use either an as-cast austenitic iron-base alloy or a forged austenitic iron-base alloy for such exhaust valves. The forged valves have shown good strength and other properties at high temperature conditions such as that to be experienced in the currently altered engine cycles; however, the forged valves are extremely expensive both as the result of their chemistry and their particular processing. A nominal analysis for a typical forged high-temperature alloy presently being used for automotive exhaust valve applications, would include: 21% chromium, 4% nickel, 9% manganese, 0.5% carbon, 0.4% nitrogen, 0.25% max. silicon, and the balance substantially iron. The as-cast valves, although offering considerable savings in processing, do not possess adequate high temperature properties to meet the needs of exhaust valve applications in the higher temperature operating engines. A typical analysis for an as-cast high-temperature alloy used currently in automotive exhaust valve applications includes: 15–18% chromium, 13–16% nickel, 0.3–0.6% manganese, 0.74–0.95% carbon, 2–3.5% silicon, 1% max. molybdenum, 1% max. copper, 3% max. cobalt, 0.35% max. of other impurities in total, and the remainder iron. The latter as-cast alloy should have a minimum hardness of $R_b$ 97 to assure a proper austenitic structure.

SUMMARY OF THE INVENTION

A primary object of this invention is to provide a new austenitic stainless steel which will offer greater strength, fatigue resistance, ductility and hardness at elevated operating temperatures of the order of 1600°–1700°F than that offered by equivalent cast materials now known to the art. Equivalent cast materials, as now presently known, provide good strength, ductility and hardness only up to temperature levels of 1450°F.

Another object of this invention is to provide an as-cast steel useful at an elevated temperature level of 1700°F and which is as economical to produce as the presently known as-cast austenitic steels having 16% chromium, 13% nickel, less than 1% manganese and 0 molybdenum.

Specific features pursuant to the above objects comprise (a) providing the new as-cast steel with a service hardness of at least $R_b$56 at a temperature of 1700°F and a service hardness of at least $R_c$30 at a temperature of 900°F; (b) providing a ductility, determined by elongation, of 6% or more at 1700°F; and (c) providing a creep strength at 1700°F of at least 9 k.s.i. and an ultimate tensile strength of at least 45 k.s.i. at an elevated temperature of 1700°F.

DETAILED DESCRIPTION

For the purposes of this invention, an austenitic steel having the high temperature physical qualities herein desired, should possess a hot hardness greater than 50 $R_b$ or 90 DPH at 1650°F or greater than 80 DPH at 1700°F; a high temperature creep rupture strength (taken with reference to a 100 hour creep rupture test) which is of at least 7 k.s.i. at 1650°F and at least 5 k.s.i. at 1700°F; short-time tensile properties should provide for an ultimate strength of at least 25 k.s.i. at 1700°F; and ductility, measured by percent elongation, should be greater than 6% at 1700°F.

It was found if the following critical chemical adjustments are made to the composition of a typical commercial as-cast austenitic steel, the goals of this invention would be met: (a) chromium and nickel, providing the austenitic stainless steel character, are varied with chromium being slightly increased and the nickel being moderately decreased; (b) molybdenum, normally absent, is added in a critical range of 6–9%; (c) an alternate austentic stabilizer is promoted by adding at least 2–3 additional units of manganese; (d) the upper limit of silicon is increased and (e) carbon is reduced at its lower limit with the upper carbon limit being made a strict requirement so as to avoid carbide embrittlement.

By following the above adjustments to a typical austenitic stainless steel valve composition, as used today in the auto industry, two important phenomenon take place. High temperature tensile strength, rupture strength and hardness, are dramatically increased as the result of the increase in the strength of the strain field which hinders defect motion when the metallurgical matrix is stressed. By injecting the large atoms of molybdenum, a controlled degree of solid solution strengthening takes place. The large molybdenum atoms strain harden the austenitic matrix by increasing the lattice parameter or cell size. The increase or change in the lattice parameter by the presence of molybdenum atoms creates internal strain fields within the lattice. Defect motions, accelerated by high stress and temperature are impeded by these internal strain fields and therefore more stress can be accommodated thereby increasing the life of the material. In essence, the defect must detour or pass through the strain field. In either event, strengthening occurs because of this impedance. Molybdenum atoms will also form intermetallic compounds in iron-nickel alloy systems. These phases, when present in a proper morphology, act as strengthening agents in a manner similar to that created by solid solution hardening, in that the strain defect will be impeded.

Secondly, carbon plays an important role in several respects. First, as molybdenum atoms are injected into the austenitic steel matrix, the carbon will be adjusted because carbon will attempt to react with molybdenum from the matrix and tend to form an alloyed carbide. This reduces the effect of solid solution strengthening. In addition, carbon will embrittle the matrix by collecting at the grain boundaries, and/or heavy concentrations of the carbide will occur within the matrix. Since the carbide material is very brittle, there must be a proper balancing of the molybdenum and carbon contents so that reduction in the solid solution strengthening is minimized and weakening does not take place at the grain boundaries due to a continuous grain boundary film or a high number of precipitated particles at the grain boundary. The embrittlement must be avoided in order to obtain increased low cycle fatigue life. If the carbides at the grain boundary are widely spaced and discretely organized, the possibility of grain boundary sliding and dislocation mechanisms will be hindered, thereby controlling high temperature deformation. Accordingly, a well dispersed structure of carbides at the grain boundary and within the matrix is very desirable.

The examples (meeting the above goals and desired metallurgical mechanisms), as set forth in Table I, illustrate the improvement in high temperature physical properties as directly compared with a conventional forged austenitic stainless steel (popularly known as 24-4 in alloy) and a typical prior art cast austenitic stainless steel composition identified as Example 2.

With respect to all of the example 1–6, the following procedure was employed:

Test samples for the 21-4-N alloy were machined from the solution and aged ⅞ inch diameter barstock used to fabricate forged valves. Test samples for the cast alloys, defined as prior art, and A003 as well as A005 were machined from keel blocks cast in ½ inch Y-block sand molds. These samples were cast from the same material used to cast production valve samples required for quality, machining, and fatigue testing. A 250 lb. heat for each alloy was melted in an induction furnace using standard melting ferroalloys. Cast samples were not heat-treated although elevated temperature aging can enhance rupture life. Tensile, rupture, and hardness data were determined by using standart ASTM testing methods. Hardness data were obtained on specimens machined from valve heads.

It has now been determined that to provide for a cost-high strength balance in an austenitic stainless steel, the valve throat should have superior high strength and hardness characteristics and the valve stem should have excellent hardness and fatigue properties but at a lower temperature. Accordingly, the composition should consist essentially of: 0.35–0.95 carbon, 16–19% chromium, 10–12.9% nickel, 6–9% molybdenum, 2.5–4.0% manganese, 2.5% maximum silicon, 1.0% maximum copper, 3.0% maximum cobalt, and 0.2% maximum on each other element as an impurity and 0.35% maximum on all other impurity elements, and the remainder being substantially iron.

With this modified chemistry, the use of a precise balanced range of molybdenum and carbon gives increased high temperature tensile and rupture strength, as well as high temperature or hot hardness. Preferably, the molybdenum should be in the range of 7–8% to hold costs in line as well as giving optimum creep strength. Preferably, the manganese should be in the range of 2.5–3.5 so as to maximize the austenitic matrix stability by this lower cost substitution for nickel. Furthermore, the nickel should be in the range of 10–12% which achieves maximum cost reduction without sacrificing austenitic matrix stability when the manganese is adjusted as heretofore. Carbon should be adjusted within the 0.35/0.75 range for optimum fatigue properties.

I claim as my invention:

1. An austenitic stainless steel casting effective to provide a 100 hour rupture strength of 1650°F of at least 9 k.s.i., a rupture strength of at least 5,000 p.s.i. at a temperature level of 1700°F, a ductility of at least 6% as measured by percent elongation at 1700°F, and a hardness of at least $R_c30$ at 900°F, the steel consisting essentially of, by weight 2.5–4.0% manganese, 6–9% molybdenum, 16–19% chromium, 10–12% nickel, 0.35–0.95% C, the remainder being substantially iron.

2. The casting as in claim 1, in which the ductility is measured by percent elongation, is in excess of 8% at 1500°F, and the tensile strength is at least 50 k.s.i. at a temperature level of 1500°F.

3. The casting as in claim 1, in which, in addition to said recited elements, consists essentially of 2.5% maximum silicon.

4. The casting as in claim 1, in which, in addition to said recited elements, consists essentially of 1.0% maximum copper.

5. The casting as in claim 1, in which, in addition to said recited elements, consists essentially of 3.0% maximum cobalt.

6. The casting as in claim 1, in which, in addition to said recited elements, consists essentially of 2.5% maximum silicon, 1.0% maximum copper, 3.0% maximum cobalt, other elements each being no greater than 0.2% maximum and all other elements as a total being no greater than 3.5% maximum.

7. The casting as in claim 1, in which said molybdenum is essentially about 7.5%.

8. The casting as in claim 1, in which said manganese is essentially about 3.1–3.5%.

* * * * *

UNITED STATES PATENT AND TRADEMARK OFFICE

CERTIFICATE OF CORRECTION

PATENT NO. : 3,976,476

DATED : August 24, 1976

INVENTOR(S) : Robert Mrdjenovich

It is certified that error appears in the above-identified patent and that said Letters Patent are hereby corrected as shown below:

Assignee: Ford Motor Company
Wayne, Michigan

Attorney, Agent, or Firm - Joseph W. Malleck; Keith L. Zerschling

Signed and Sealed this

*Twelfth* Day of *September 197*

[SEAL]

*Attest:*

RUTH C. MASON
*Attesting Officer*

DONALD W. BANNER
*Commissioner of Patents and Trademarks*